US006899410B2

(12) United States Patent
Jeanmaire

(10) Patent No.: US 6,899,410 B2
(45) Date of Patent: May 31, 2005

(54) CONTINUOUS INK-JET PRINTING APPARATUS WITH INTEGRAL CLEANING

(75) Inventor: David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 281 days.

(21) Appl. No.: 10/606,106

(22) Filed: Jun. 25, 2003

(65) Prior Publication Data

US 2004/0017421 A1 Jan. 29, 2004

Related U.S. Application Data

(63) Continuation of application No. 09/906,486, filed on Jul. 16, 2001, now abandoned.

(51) Int. Cl.[7] ..... B41J 2/15
(52) U.S. Cl. ..... 347/21; 347/25
(58) Field of Search ..... 347/21, 25, 34, 347/74, 77

(56) References Cited

U.S. PATENT DOCUMENTS 4,068,241 A * 1/1978 Yamada ..... 347/75
4,626,869 A 12/1986 Piatt ..... 347/74
4,914,522 A * 4/1990 Duffield et al. ..... 358/296
4,970,535 A 11/1990 Oswald et al. ..... 347/75
5,461,407 A 10/1995 Robertson et al. ..... 347/82
6,588,888 B2 * 7/2003 Jeanmaire et al. ..... 347/77

FOREIGN PATENT DOCUMENTS

JP 62-218139 9/1987

* cited by examiner

*Primary Examiner*—Juanita D. Stephens
*Assistant Examiner*—Blaise Mouttet
(74) *Attorney, Agent, or Firm*—William R. Zimmerli

(57) ABSTRACT

An ink jet printing apparatus having a cleaning station that is structurally integrated with a droplet deflector is provided. The apparatus includes an ink droplet forming mechanism formed from a printhead having at least one nozzle for ejecting a stream of ink droplets of different volumes, a pneumatic droplet deflector for producing a flow of gas that transversely impinges the droplet stream of the printhead in order to separate ink droplets of different volumes from one another. The droplet deflector includes a pressurized gas source, which may be an air blower, and a plenum for conducting the gas flow generated by the gas source. The cleaning station is formed at least in part from the plenum of the droplet deflector, and provides a flow of both a liquid cleaning fluid and a flow of gas to periodically clean the printhead of the ink droplet forming mechanism.

39 Claims, 5 Drawing Sheets

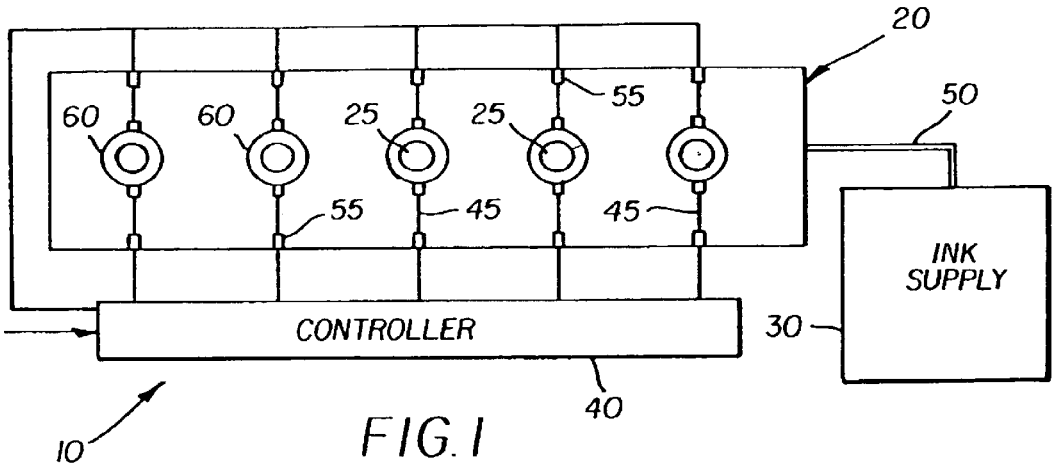
FIG. 1
FIG. 2(a)
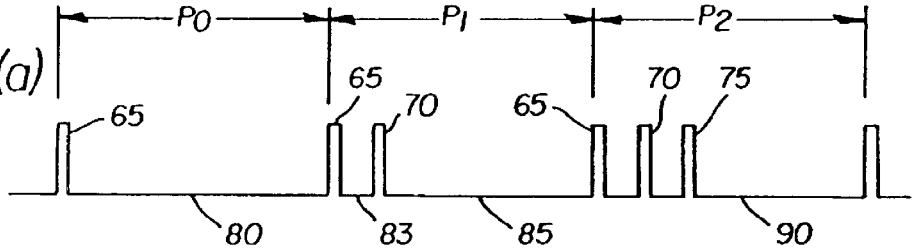
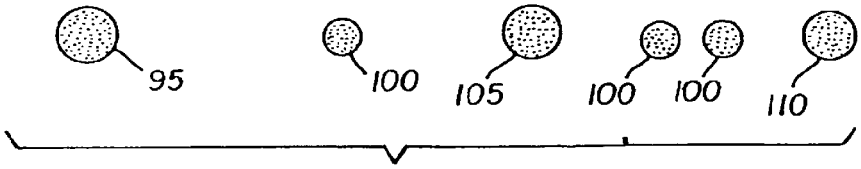
FIG. 2(b)

P1
P1
65
65
65
80
80
95
95
95

P0
P0
65
65
65
83
83
83
100
100
100
100

P0
P1
65
65
65
65
83
83
83
100
100
95
100

CONTINUOUS INK-JET PRINTING APPARATUS WITH INTEGRAL CLEANING

CROSS REFERENCE TO RELATED APPLICATIONS

This is application is a continuation of commonly assigned patent application U.S. Ser. No. 09/906,486, filed Jul. 26, 2001, now abandoned entitled "A Continuous Ink-Jet Printing Apparatus With Integral Cleaning" in the name of David L. Jeanmaire.

FIELD OF THE INVENTION

This invention relates generally to the field of ink jet printing devices, and in particular to a continuous ink jet printer in which a gas-flow type droplet deflector is used both to deflect non-printing droplets from printing droplets and to implement a printhead cleaning operation.

BACKGROUND OF THE INVENTION

Digitally controlled color ink jet printing capability is accomplished by one of two technologies referred to as "drop-on-demand" and "continuous stream," respectively. Both require independent ink supplies for each of the colors of ink provided. Ink is fed through channels formed in the printhead. Each channel includes a nozzle from which droplets of ink are selectively extruded and deposited upon a medium. Typically, each technology requires separate ink delivery systems for each ink color used in printing. Ordinarily, the three primary subtractive colors, i.e. cyan, yellow and magenta, are used because these colors can produce, in general, up to several million perceived color combinations.

Drop-on-demand ink jet printing, provides ink droplets for impact upon a print medium using a pressurization actuator (thermal, piezoelectric, etc.). Selective activation of the actuator causes the formation and ejection of a flying ink droplet that crosses the space between the printhead and the print medium and strikes the print medium. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle thus helping to keep the nozzle clean. Conventional drop-on-demand ink jet printers utilize a pressurization actuator to produce the ink jet droplet at orifices of a print head. Typically, one of two types of actuators are used including heat actuators and piezoelectric actuators. With heat actuators, a heater, placed at a convenient location, heats the ink. This causes a quantity of ink to phase change into a gaseous steam bubble that raises the internal ink pressure sufficiently for an ink droplet to be expelled. With piezoelectric actuators, an electric field is applied to a piezoelectric material possessing properties that create a mechanical stress in the material, thereby causing an ink droplet to be expelled. The most commonly produced piezoelectric materials are ceramics, such as lead zirconate titanate, barium titanate, lead titanate, and lead metaniobate.

By contrast, continuous stream ink jet printing, uses a pressurized ink source which produces a continuous stream of ink droplets. Electrostatic charging devices are placed close to the point where a filament of working fluid breaks into individual ink droplets. The ink droplets are electrically charged and then directed to an appropriate location by deflection electrodes having a large potential difference.

When no print is desired, the ink droplets are deflected into an ink capturing mechanism (catcher, interceptor, gutter, etc.) and either recycled or discarded. When printing is desired, the ink droplets are not deflected and allowed to strike a print medium. Alternatively, deflected ink droplets may be allowed to strike the print medium, while non-deflected ink droplets are collected in the ink capturing mechanism. Continuous ink jet printing devices are faster than drop on demand devices and produce higher quality printed images and graphics. However, each color printed requires an individual droplet formation, deflection, and capturing system.

One of the problems associated with both types of ink jet technologies is that of printhead reliability. For continuous ink jet printers a common problem is initial stream instability that occurs when the printheads are turned on during start-up. Initial stream instability is often due to dynamics associated with surface wetting near the nozzles as well as any differential wetting that results from surface contamination. Initial aberrations of the ink stream may also originate from the presence of air bubbles in the printhead. Low ink pressures during the start-up and shut-down transitions is another common source of stream instability in the form of temporary jet misdirection. Prior art methods of coping with such instabilities require the use of a cap or nozzle that move over the printhead nozzles at shut-down and/or start-up time and effectively contain the ink streams and/or ink droplets emanating from the print head at start-up and/or shutdown time.

In addition to stream instabilities that occur during start-up and shut-down, ink jet printheads develop problems from ink which has dried around nozzles after a period of operation. A combination of dried ink, paper fibers and dust can result in partial or complete blocking of nozzle apertures. Periodic maintenance is normally performed to remove dried ink and these other contaminates from the nozzle plate and ink collecting structures. It is well known in the art to rinse the head with water and blow air across it to perform the maintenance operation. An exemplary technique for cleaning with fluids (including air) is given in U.S. Pat. No. 4,970,535 to Oswald et al. in 1990. This method includes enclosing the print head with a cavity having an inlet and an outlet such that a fluid is directed through the inlet and cavity at an angle that is substantially tangential to the nozzle aperture. Ink disposed around the nozzles is thusly carried away through the outlet. Other prior art techniques require the use of a wiping device for dried ink from the nozzles. For instance physical wipers, such as squeegees and cloth wipes are moved across or blotted against the face.

A final printhead reliability problem is caused by the storage of printheads between periods of use wherein ink dries out in and adjacent to the nozzles. One solution is to keep a moist or solvent rich environment proximate to the nozzles during storage. For example, U.S. Pat. No. 4,626,869 to Piatt in 1985 describes a system wherein the critical components of the printhead assembly are stored in a wet condition.

To provide for the maintenance operations necessary to prevent the aforementioned reliability problems, the printer may include a built-in start-up station, also called a home station, which is located at the side of the printhead. The printhead is moved over and into sealed relation with a chamber of the home station where various cleaning, drying and diagnostic operations are performed. While the procedures performed by such start-up stations are quite effective, the addition of such stations add considerable complexity and cost to the printing apparatus.

Clearly, there is a need for a mechanism that effectively provides the needed maintenance and cleaning operations on the printhead of an ink jet printer without the need for a dedicated start-up maintenance station. Ideally, such operations could be implemented by structures easily integrated into the printhead itself to simplify the printer structure and reduce printer fabrication costs. Finally, it would be desirable if at least some of the maintenance operations could be implemented or facilitated by preexisting structures within the printer that are normally used for other purposes to further lower printer construction costs.

SUMMARY OF THE INVENTION

A primary feature of the current invention is the shared use of air plenum structures in a droplet deflector to provide the integrated functions of startup cleaning, shut-down cleaning, maintenance and storage, in addition to the usual function of droplet separation. In this implementation, provision is made to either direct air or cleaning fluids over the surface of the print head.

To this end, the invention is an ink jet printing apparatus for printing an image that comprises an ink droplet forming mechanism including a printhead having at least one nozzle for ejecting a stream of ink droplets having a selected one of at least two different volumes; a droplet deflector for producing a flow of gas that separates ink droplets having different volumes from one another, and a cleaning station formed at least in part from the droplet deflector for providing a flow of fluid over the printhead to clean and maintain it.

The droplet deflector includes a pressurized gas source for producing a flow of gas and a plenum for conducting the gas flow across the stream of ink droplets to separate them from one another. Advantageously, the cleaning station is formed at least in part from the plenum and the gas source of the droplet deflector, and further includes a source of liquid cleaning fluid (which may be water) connected to the plenum via a valve. In operation, the valve may be opened to admit a flow of cleaning fluid over the printhead. Afterwards, the source of pressurized gas (which may be an air blower) may be actuated to dry excess cleaning fluid from the surface of the printhead.

The ink jet printing apparatus may further comprise an ink catcher for catching ink droplets not used to produce an image, and a recovery reservoir for collecting ink droplets caught by the catcher for recycling. Advantageously, the cleaning station may also be formed in part from the recovery reservoir, which serves the additional function of collecting used liquid cleaning fluid directed across the face of the printhead during a cleaning operation. Preferably, the liquid cleaning fluid used is the same type of solvent used as the basis of the ink forming the droplets so that the collection of used cleaning fluid will not interfere with the recycling of ink collected from the ink catcher.

Finally, the ink jet printing apparatus may comprise a parking mechanism linked to the printhead for withdrawing and extending it from a parking position to an operating position with respect to the droplet deflector and an imaging medium. During storage, the parking mechanism withdraws the printhead into a parking position where it may be stored for relatively long periods of non-use with a moistening sponge placed over the ink jet nozzles of the printhead.

BRIEF DESCRIPTION OF THE DRAWINGS

Other features and advantages of the present invention will become apparent from the following description of the preferred embodiments of the invention and the accompanying drawings, wherein:

FIG. 1 is a schematic plan view of a printhead made in accordance with a preferred embodiment of the present invention;

FIGS. 2(*a*) and 2(*b*) show diagrams illustrating a frequency control of a heater used in the preferred embodiment of FIG. 1 and the resulting ink droplets;

DETAILED DESCRIPTION OF THE INVENTION

Figure 3:
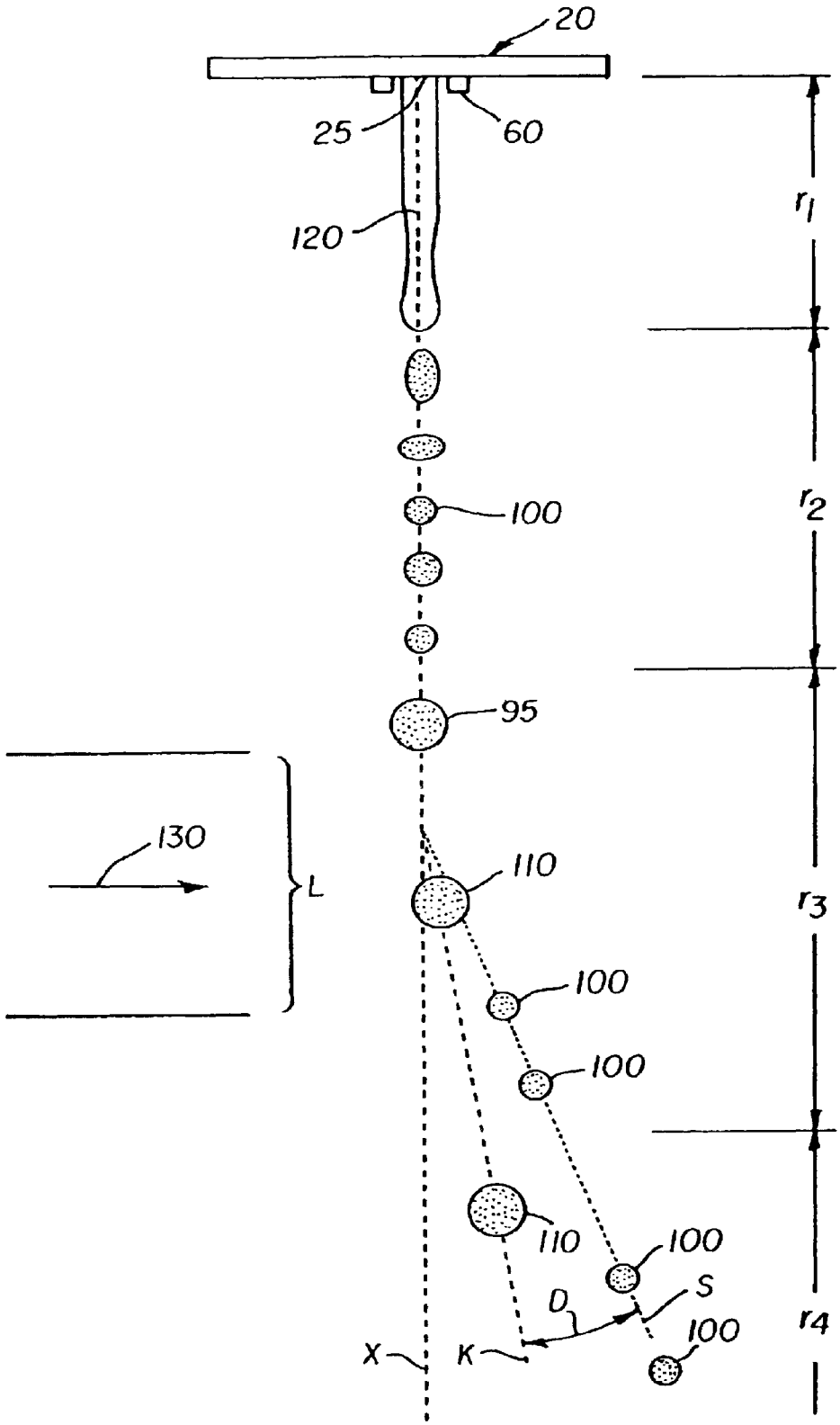
FIG. 3 is a cross-sectional view of an ink jet printhead made in accordance with the preferred embodiment of the present invention.

The present description will be directed in particular to elements forming part of, or cooperating more directly with, apparatus in accordance with the present invention. It is to be understood that elements not specifically shown or described may take various forms well known to those skilled in the art.

Referring to FIG. 1, an ink droplet forming mechanism 10 of a preferred embodiment of the present invention is shown. Ink droplet forming mechanism 10 includes a printhead 20, at least one ink supply 30, and a controller 40. Although ink droplet forming mechanism 10 is illustrated schematically and not to scale for the sake of clarity, one of ordinary skill in the art will be able to readily determine the specific size and interconnections of the elements of the preferred.

In a preferred embodiment of the present invention, printhead 20 is formed from a semiconductor material (silicon, etc.) using known semiconductor fabrication techniques (CMOS circuit fabrication techniques, micro-electro mechanical structure (MEMS) fabrication techniques, etc.). However, it is specifically contemplated and, therefore within the scope of this disclosure, that printhead 20 may be formed from any materials using any fabrication techniques conventionally known in the art.

Again referring to FIG. 1, at least one nozzle 25 is formed on printhead 20. In an example presented here, nozzles 25 are 9 micrometers in diameter. Nozzle 25 is in fluid communication with ink supply 30 through ink passage 50 also formed in printhead 20. It is specifically contemplated, therefore within the scope of this disclosure, that printhead 20 may incorporate additional ink supplies in the manner of 30 and corresponding nozzles 25 in order to provide color printing using three or more ink colors. Additionally, black and white or single color printing may be accomplished using a single ink supply 30 and nozzle(s) 25.

Heater 60 is at least partially formed or positioned on printhead 20 around corresponding nozzle 25. Although heater 60 may be disposed radially away from the edge of corresponding nozzle 25, heater 60 is preferably disposed close to corresponding nozzle 25 in a concentric manner. In a preferred embodiment, heater 60 is formed in a substantially circular or ring shape and consists principally of an electric resistive heating element electrically connected to electrical contact pads 55 via conductors 45.

Conductors 45 and electrical contact pads 55 may be at least partially formed or positioned on printhead 20 and provide an electrical connection between controller 40 and heater 60. Alternatively, the electrical connection between controller 40 and heater 60 may be accomplished in any well-known manner. Additionally, controller 40 is typically a logic controller, programmable microprocessor, etc. operable to control many components (heater 60, ink droplet forming mechanism 10, etc.) in a desired manner.

Referring to FIG. 2(*a*), a schematic example of the electrical activation waveform provided by controller 40 to heater 60 is shown. In general, a rapid pulsing of the heater 60 forms small ink droplets, while slower pulsing creates larger drops. In the example presented here, small ink droplets are to be used for marking the image receiver, while larger droplets are captured for ink recycling.

In a preferred implementation, multiple drops per nozzle per image pixel are created. In FIG. 2(*a*), P is the time associated with the printing of an image pixel, and the subscript indicates the number of printing drops to be created during the pixel time. The schematic illustration in (b) shows the drops that are created as a result of the application of waveform (a). A maximum of two small printing drops is shown for simplicity of illustration, however, it must be understood that the reservation of more time for a larger count of printing drops is clearly within the scope of this invention. In the drop formation for each image pixel, a non-printing large drop 95, 105, or 110 is always created, in addition to a variable number of small, printing drops. The waveform of activation of heater 60 for every image pixel begins with electrical pulse time 65, typically from 0.1 to 10 microseconds in duration, and more preferentially 0.5 to 1.5 microseconds. The further (optional) activation of heater 60, after delay time 83, with an electrical pulse 70 is conducted in accordance with image data wherein at least one printing drop 100 is required as shown for interval $P_1$. For cases where the image data requires that still another printing drop be created as in interval $P_2$, heater 60 is again activated after delay 83, with a pulse 75. Heater activation electrical pulse times 65, 70, and 75 are substantially similar, as are all delay times 83. Delay time 83 is typically 1 to 100 microseconds, and more preferentially, from 3 to 6 microseconds. Delay times 80, 85, and 90 are the remaining times after pulsing is over in a pixel time interval P and the start of the next image pixel. All small, printing drops 100 are the same volume, however the volume of the larger, non-printing drops 95, 105, and 110 varies depending on the number of small drops 100 created in the pixel time interval P; the creation of small drops takes mass away from the large drop during the pixel time interval P. The delay time 90 is chosen to be significantly larger than the delay time 83, so that the volume ratio of large non-printing-drops 110 to small printing-drops 100 is preferentially a factor of 4 or greater Referring to FIG. 3, the operation of printhead 20 in a manner such as to provide an image-wise modulation of drop volumes, as described above, is coupled with an gas-flow discrimination means which separates droplets into printing or non-printing paths according to drop volume. Ink is ejected through nozzle 25 in printhead 20, creating a filament of working fluid 120 moving substantially perpendicular to printhead 20 along axis X. The physical region over which the filament of working fluid is intact is designated as $r_1$. Heater 60 is selectively activated at various frequencies according to image data, causing filament of working fluid 120 to break up into a stream of individual ink droplets. Coalescence of drops often occurs in forming non-printing drops 95, 105 and 110. This region of jet break-up and drop coalescence is designated as $r_2$. Following region $r_2$, drop formation is complete in region $r_3$ and small, printing drops and large, non-printing drops are spatially separated. Beyond this region in $r_4$, aerodynamic effects can cause merging of adjacent small and large drops, with concomitant loss of imaging information. A discrimination force 130 is provided by a gas flow perpendicular to axis X. The force 130 acts over distance L, which is less than or equal to distance $r_3$. Large, non-printing drops 95, 105, and 110 have greater masses and more momentum than small volume drops 100. As gas force 130 interacts with the stream of ink droplets, the individual ink droplets separate depending on individual volume and mass. Accordingly, the gas flow rate can be adjusted to sufficient differentiation D in the small droplet path S from the large droplet path K, permitting small drops 100 to strike print media W while large, non-printing drops 95, 105, and 110 are captured by a ink guttering structure described in the apparatus below.

Figure 4:
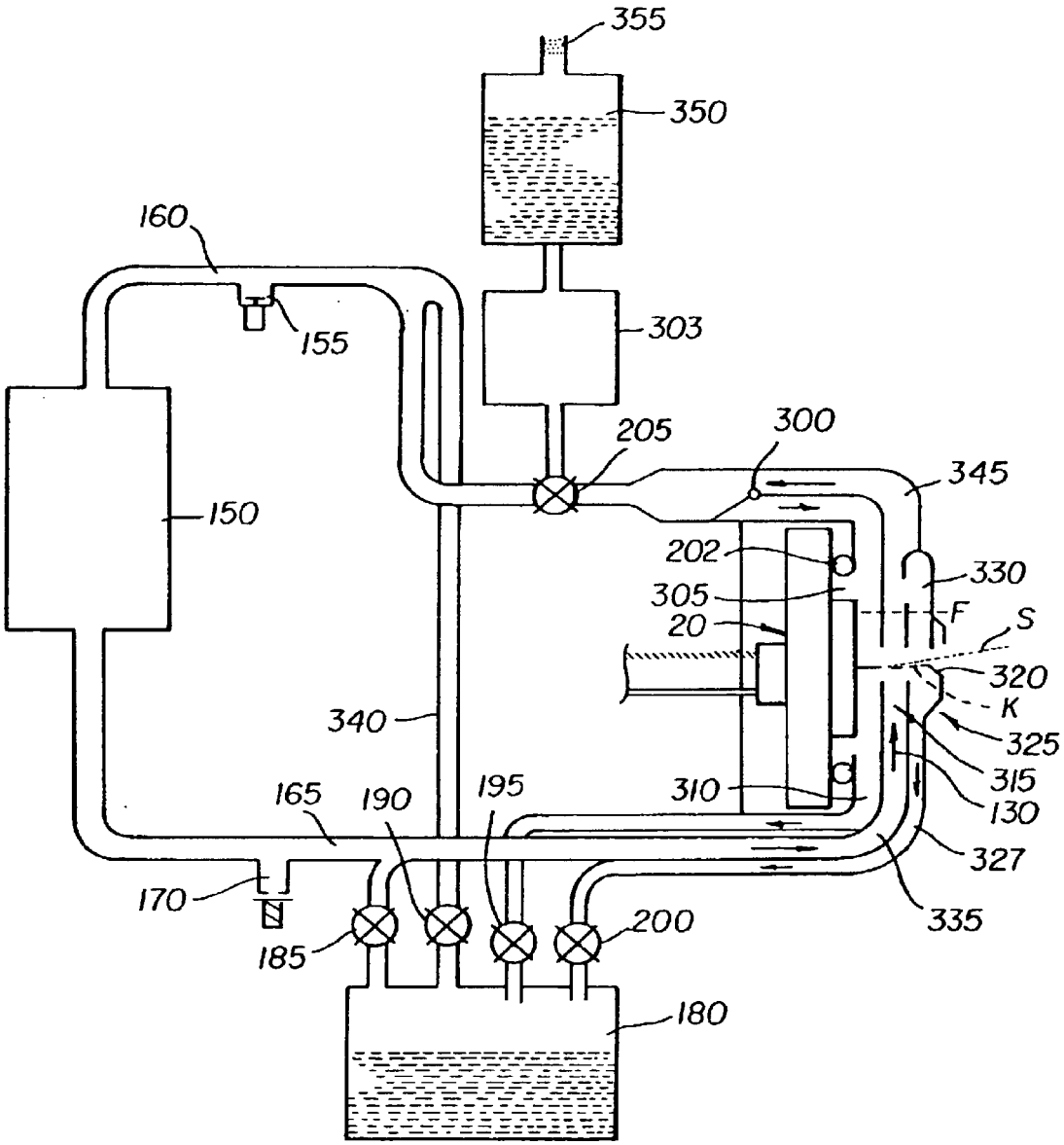
FIG. 4 is a schematic representation of an ink jet printhead made in accordance with a another embodiment of the present invention.

Referring to FIGS. 3 and 4, a printhead 20 used in a preferred implementation of the current invention is shown schematically along with associated fluidic connections. Large volume ink drops 95, 105 and 110 and small volume ink drops 100 are formed from ink ejected from printhead 20 substantially along ejection paths X a stream. A droplet deflector 315 contains upper plenum 345 and lower plenum 335 which facilitate a laminar flow of gas in droplet deflector 315. Pressurized air from blower 150 enters lower plenum 335 which is disposed opposite plenum 345 and promotes laminar gas flow while protecting the droplet stream moving along path X from external air disturbances. In the center of droplet deflector 315 is positioned proximate path X. The application of force 130 due to gas flow separates the ink droplets into small-drop path S and large-drop paths K.

An ink collection structure 325, disposed adjacent to plenum 335 near path X, intercepts path K of large drops 95, 105, and 110, while allowing small ink drops 100 traveling along small droplet paths S to continue on to a recording media. Large, non-printing ink drops 95, 105, and 110 strike ink catcher 320 in ink collection structure 325. Ink recovery conduit 327 returns ink to recovery reservoir 180 through normally-open valve 200. Negative pressure in conduit 327, communicated from blower 150 through line 340 and normally-open value 195, facilitates the motion of recovered ink to the recovery reservoir 180. The pressure reduction in conduit 327 is sufficient to draw in recovered ink, however it is not large enough to cause significant air flow to substantially alter drop paths S.

A small portion of the gas flowing through upper plenum 345 is re-directed by plenum 330 to the entrance of ink collection structure 325. The positive gas pressure in supply plenum 165 is controlled by pressure regulator 170, wherein excess pressure is released to the external environment. In a complementary way, the negative gas pressure in plenum 160 is controlled by regulator 155. Regulators 170 and 155 are adjusted so that the gas pressure in the print head assembly near ink catcher 320 is positive with respect to the ambient air pressure external to the printhead assembly. Environmental dust and paper fibers are thusly discouraged from approaching and adhering to ink catcher 320 and are additionally excluded from entering ink recovery conduit 327.

"O" ring seals 202 and spill channel 310 provide a means to capture and recycle ink that comes from mis-directed nozzles in printhead 20 which fail to properly enter droplet deflector 315.

During all times when not printing (jets not running), the print assembly is translated to a parking position where a non-porous elastomeric pad (not shown) is pressed over the exit port of the print assembly near ink catcher 320. This pad provides a fluidic seal to keep any ink or cleaning solvents from leaking out of the printhead assembly.

Prior to initiation of the start-up sequence, the printhead assembly is in the "parked" position, and the exit port is sealed. The printhead is stored in a wet state, to be discussed in more detail later. Valves 185, 195, and 200 are closed so that channel 310 and plenum 335, and conduit 327 contain a cleaning/storage solvent. At startup, valves 185, 195, and 200 open, allowing fluid from channel 310, plenum 335 and conduit 327 to drain into recovery reservoir 180. Valve 190 closes and blower 150 reverses direction, so that the pressure in plenum 160 is greater than in plenum 165. Since pressure regulators 170 and 155 do not open under reverse-pressure conditions, the air flow rate near the printhead, in droplet deflector 315 is substantially higher than during printing conditions, thus facilitating the removal of cleaning solvent from the surface of printhead 20. The toggling of valve 300 sends pressurized air from plenum 160 alternately into plenum 345 and conduit 305. With the air flowing in this manner, the ink supply pressure to printhead 20 is gradually increased, and jetting begins. The air flow assists in stabilizing the jets.

In order to prepare for printing, blower 150 is operated in the mode first described, where the pressure in plenum 165 is greater than in plenum 160. Valve 300 moves to the position that allows plenum 345 to communicate with plenum 160. The printhead assembly is then moved from the "park" to a printing location, facing the receiver media and normal printing activity resumes.

Periodically, a maintenance cycle is carried out by again returning to the "park" position and sealing the head assembly exit port. Three-way valve 205 and valve 300 are moved to positions which allow solenoid pump 303 to communicate with channel 305. A cleaning solvent (e.g. water) is drawn from reservoir 350 by pump 303 and caused to flow across the printhead 20 surface. Dried ink is removed and is carried through channel 310 into recycling reservoir 180. Following this flushing of the printhead, valve 205 is moved so that plenum 345 again communicates with plenum 160. Blower 150 is operated in reverse mode as previously described for blowing air across the printhead as in start-up conditions.

For printhead storage, the printhead assembly is moved to the "park" position where the head assembly exit port is sealed. Ink pressure to the printhead is removed causing jetting to cease and blower 150 is turned off. Valves 185, 195 and 200 are closed. Valves 205 and 300 are moved to a position which allows solvent pump 303 to communicate with channel 305. Solvent from tank 350 is allowed to flow and accumulates in channel 310, plenum 165, and conduit 327, submersing the nozzles in printhead 20 until level F is reached.

In an alternate implementation of the current invention the principle of the printing operation is reversed, where the larger droplets are used for printing, and the smaller drops recycled. An example of this mode is presented here. In this example, only one printing drop is provided for per image pixel, thus there are two states of heater 60 actuation, printing or non-printing. The electrical waveform of heater 60 actuation for the printing case is presented schematically as FIG. 5(*a*). The individual large ink drops 95 resulting from the jetting of ink from nozzles 25, in combination with this heater actuation, are also shown schematically in FIG. 5(*a*). Heater 60 activation time 65 is typically 0.1 to 5 microseconds in duration, and in this example is 1.0 microsecond. The delay time 80 between heater 60 actuations is 42 microseconds. The electrical waveform of heater 60 activation for the non-printing case is given schematically as FIG. 5(*b*). Electrical pulse 65 is 1.0 microsecond in duration, and the time delay 83 between activation pulses is 6.0 microseconds. The small drops 100, as diagrammed in FIG. 5(*b*), are the result of the activation of heater 60 with this non-printing waveform.

Figures 5A, 5B, 5C:
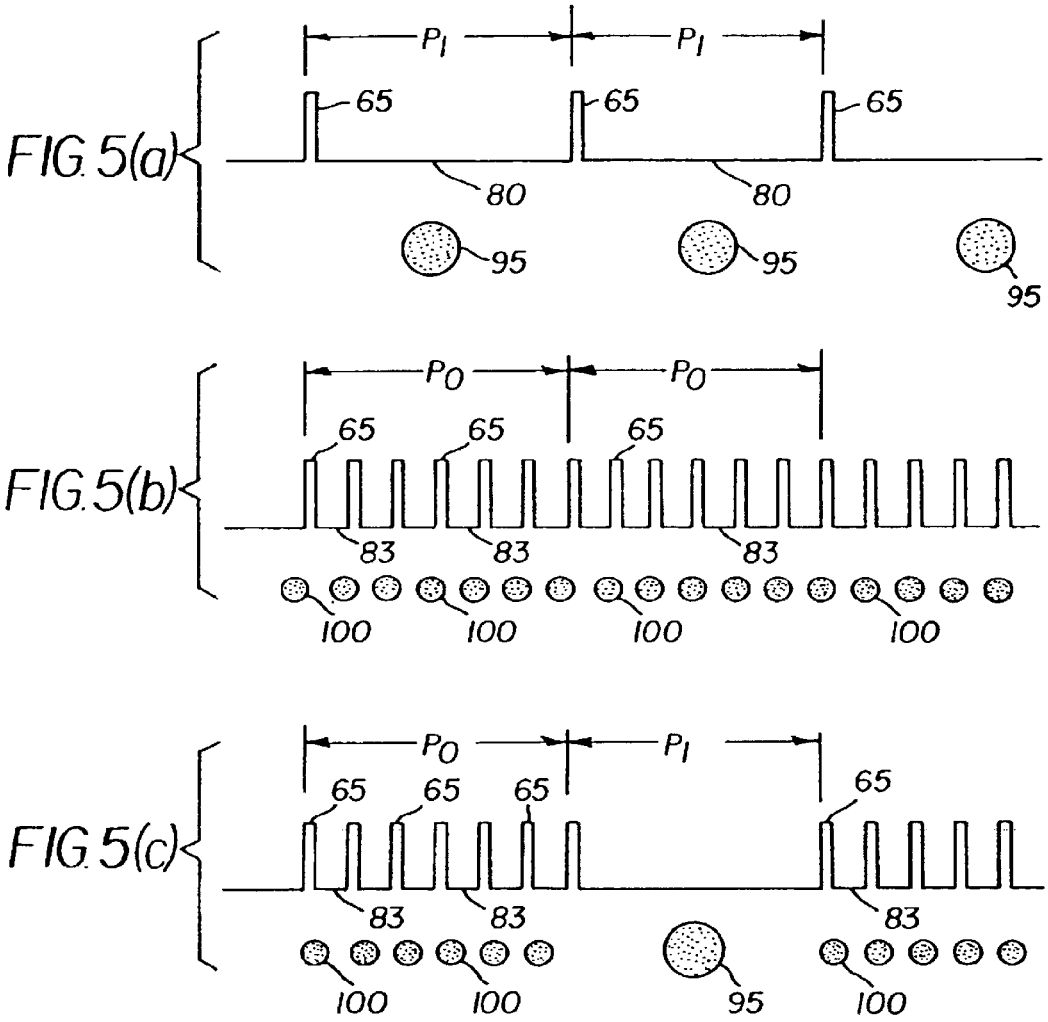
FIGS. 5(*a*)–5(*c*) are schematic representations of electrical activation waveforms and ink drops produced from the waveforms.
Figure 6:
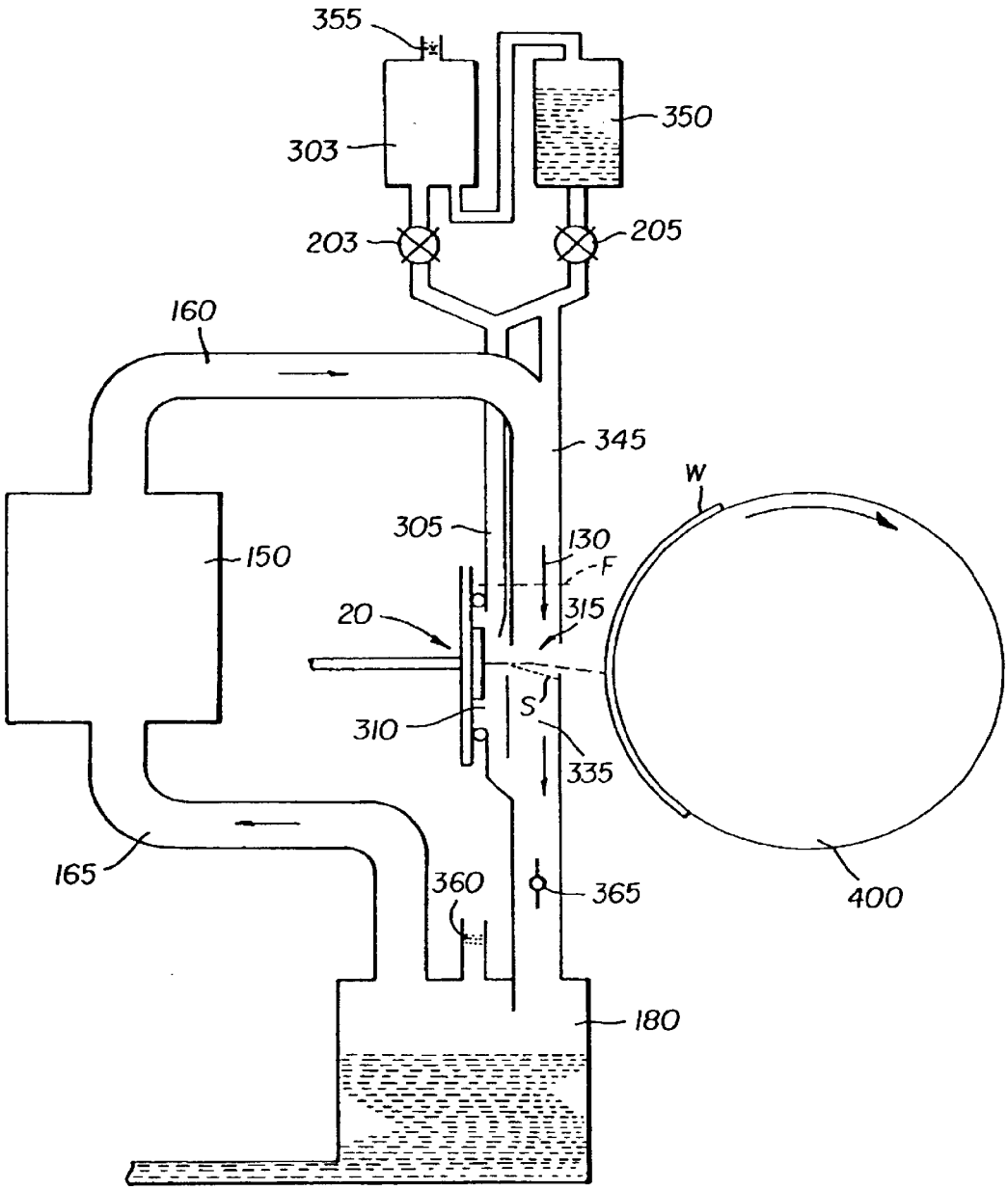
FIG. 6 is an alternative embodiment of the present invention.

FIG. 5(*c*) is a schematic representation of the electrical waveform of heater 60 activation for mixed image data where a transition is shown for the non-printing state, to the printing state, and back to the non-printing state. Schematic representation of the resultant droplet stream formed is also shown in FIG. 5(*c*). It is apparent that heater 60 activation may be controlled independently based on the ink color required and ejected through corresponding nozzles 25, movement of printhead 20 relative to a print media W, and an image to be printed Referring to FIG. 6, an alternative embodiment of the present invention is shown schematically with like elements being described using like reference signs. Large volume ink drops 95 and small volume ink drops 100 are formed from ink ejected from printhead 20 substantially along ejection paths X a stream. A droplet deflector 315 contains upper plenum 345 and lower plenum 335 which facilitate a laminar flow of gas in droplet deflector 315. Pressurized air from blower 150 enters upper plenum 160 which communicates with plenum 345. Plenum 345 is disposed opposite plenum 335 and promotes laminar gas flow while protecting the droplet stream moving along path X from external air disturbances. In the center of droplet deflector 315 is positioned proximate path X. The application of force 130 due to gas flow separates the ink droplets into small-drop path S and large-drop paths K.

Plenum 335, near path X, serves as a droplet collector as well as an air flow director for droplet deflector 315. One wall of plenum 335 intercepts path S of small drops 100, while allowing large ink drops 95 traveling along large droplet path K to continue on to a recording media. Plenum 335 communicates with ink recovery reservoir 180 through normally-open valve 365. Negative pressure in plenum 335, communicated from blower 150 through line 165 and ink recovery reservoir 180, facilitates the motion of recovered ink to the recovery reservoir 180. The pressure reduction in conduit 327 is sufficient to draw in recovered ink, however it is not large enough to cause significant air flow to substantially alter drop path K.

Bleed port and filter 360 allow some external air to be drawn into ink recovery reservoir 180. This action causes the air pressure near the droplet path K to be slightly positive with respect to the atmosphere external to the printhead assembly. Environmental dust and paper fibers are thusly discouraged from approaching and adhering to the walls of plenum 335.

Spill channel 310 provides a means to capture and recycle ink that comes from mis-directed nozzles in printhead 20 which fail to properly enter droplet deflector 315.

In operation, a recording media W is transported in a direction transverse to axis X by print drum 400 in a known manner. Transport of recording media W is coordinated with movement of print mechanism 10. This can be accomplished using controller 40 in a known manner. Recording media W may be selected from a wide variety of materials including paper, vinyl, cloth, other fibrous materials, etc.

During all times when not printing (jets not running), the print assembly is translated to a parking position where a non-porous elastomeric pad (not shown) is pressed over the exit port of the print assembly near ink path K. This pad provides a fluidic seal to keep any ink or cleaning solvents from leaking out of the printhead assembly.

Prior to initiation of the start-up sequence, the printhead assembly is in the "parked" position, and the exit port is sealed. The printhead is stored in a wet state, as in the previous example of FIG. 4. Valve 365 is closed so that channel 310 and plenum 335 contain a cleaning/storage solvent. At startup, valve 365 opens, allowing fluid from channel 310 and plenum 335 to drain into recovery reservoir 180. Blower 150 is capable of two-speed operation, and the higher speed is selected, so that the air flow rate near the printhead, in droplet deflector 315 is substantially higher than during printing conditions, thus facilitating the removal of cleaning solvent from the surface of printhead 20. With the air flowing in this manner, the ink supply pressure to printhead 20 is gradually increased, and jetting begins.

In order to prepare for printing, blower 150 is operated in the slower-speed mode. The printhead assembly is then moved from the "park" to a printing location, facing the receiver media and is prepared for normal printing operation.

A maintenance cycle is carried out by returning to the "park" position and sealing the head assembly exit port. Pump 303 draws in external air through filter 353 and pressurizes the cleaning fluid in reservoir 350. Valve 205 opens which allows a cleaning solvent in reservoir 350 to flow into channel 305. Fluid is directed across the surface of printhead 20 and dried ink is removed and is carried through channel 310 into recycling reservoir 180. In addition, a portion of the cleaning fluid is directed into plenum 345 and removes dried ink from the walls of lower plenum 335. Following this flushing of the printhead, valve 205 is closed and valve 203 is opened. Compressed air from pump 303 enters channel 305 and blows excess fluid off the surface of printhead 20. Air flow from blower 150 aids in drying plenum 345 and plenum 335.

For printhead storage, the printhead assembly is moved to the "park" position where the head assembly exit port is sealed. Ink pressure to the printhead is removed causing jetting to cease and blower 150 is turned off. Valve 365 is closed. Valve 205 is opened allowing solvent from tank 350 to flow and accumulate in channel 310 and in plenum 335, submersing the nozzles in printhead 20 until level F is reached.

While the foregoing description includes many details and specificities, it is to be understood that these have been included for purposes of explanation only, and are not to be interpreted as limitations of the present invention. Many modifications to the embodiments described above can be made without departing from the scope of the invention, as is intended to be encompassed by the following claims and their legal equivalents.

Parts List

10 ink droplet forming mechanism
20 printhead
25 small nozzle
30 ink supply
35 large nozzle
40 controller
45 electrical connection
50 ink passage
55 electrical contact pad
60 heater
65 electrical pulse time
70 electrical pulse time
75 electrical pulse time
80 delay time
85 delay time
90 delay time
95 large drop
100 small drop
105 large drop
110 large drop
120 working fluid
130 force
150 blower
155 negative pressure regulator
160 plenum
165 plenum
170 positive pressure regulator
180 ink recovery reservoir
185 valve
190 valve
195 valve
200 valve
202 "O" ring seal
203 valve
205 valve
300 valve
303 pump
305 upper channel
310 spill channel
315 droplet deflector
320 ink catcher
325 ink catcher structure
327 ink recovery conduit
330 plenum
335 plenum
340 air line
345 plenum
350 cleaning solvent reservoir
355 air filter
360 air filter
400 print drum ink re
W print media
F fill level
L interaction distance
D separation distance
X ejection path
S small droplet path
K large droplet path

What is claimed is:

1. An ink jet printing apparatus for printing an image, comprising:

an ink droplet forming mechanism including a printhead having at least one nozzle for ejecting a stream of ink droplets having a selected one of at least two different volumes, said ink droplet forming mechanism being adapted to eject from said at least one nozzle at least one of said at least two different ink droplet volumes in succession;

a droplet deflector for producing a flow of gas that interacts with said ink droplet stream to separate ink droplets having said different volumes from one another, and a cleaning station formed at least in part from said droplet deflector for providing a flow of fluid over said printhead to clean and maintain said printhead.

2. The ink jet printing apparatus defined in claim 1, wherein said cleaning station provides a flow of liquid cleaning fluid over said printhead.

3. The ink jet printing apparatus defined in claim 1, wherein said fluid flow provided by said cleaning station is a gas flow over said printhead.

4. The ink jet printing apparatus defined in claim 3, wherein said gas flow over said printhead dries liquid cleaning fluid applied to said printhead.

5. The ink jet printing apparatus defined in claim 1, comprising an ink catcher, and said cleaning station provides a cleaning flow of fluid over said ink catcher.

6. The ink jet printing apparatus defined in claim 5, wherein said cleaning flow of fluid is a flow of air that discourages environmental dust and fibers from approaching and adhering to said ink catcher.

7. The ink jet printing apparatus defined in claim 1, wherein said droplet deflector includes a plenum for conducting said flow of gas across said printhead to separate said ink droplets, and said cleaning station is formed at least in part from said plenum.

8. The ink jet printing apparatus defined in claim 7, wherein said cleaning station further includes a source of liquid cleaning fluid, and a valve for selectively connecting said source to said plenum.

9. The ink jet printing apparatus defined in claim 8, wherein said liquid cleaning fluid is a solvent of the same kind used in said ink droplets.

10. The ink jet printing apparatus defined in claim 8, further comprising an ink catcher for catching ejected ink droplets from said printhead not used to print an image, and a recovery reservoir for collecting ink droplets caught by said catcher, wherein said recovery reservoir also collects used liquid cleaning fluid.

11. The drop emitter defined in claim 1, comprising an ink catcher, and said cleaning station provides a cleaning flow of fluid over said ink catcher.

12. An ink jet printing apparatus for printing an image, comprising:

an ink droplet forming mechanism including a printhead having at least one nozzle for ejecting a stream of ink droplets having a selected one of at least two different volumes said ink droplet forming mechanism being adapted to eject from said at least one nozzle at least one of said at least two different ink droplet volumes in succession;

a droplet deflector including a pressurized gas source for producing a flow of gas and a plenum for conducting said gas flow across said stream of ink droplets to separate ink droplets having said different volumes from one another, and a cleaning station formed at least in part from said droplet deflector for providing a flow of fluid over said printhead to clean and maintain said printhead.

13. The ink jet printing apparatus defined in claim 12, wherein said plenum of said cleaning station formed in part from said plenum of said droplet deflector, which conducts a flow of liquid cleaning fluid over said printhead.

14. The ink jet printing apparatus defined in claim 13, wherein said plenum also conducts a flow of gas over said printhead to dry said printhead from said liquid cleaning fluid.

15. The ink jet printing apparatus defined in claim 13, further comprising an ink catcher for capturing ink droplets ejected from said printhead that are not used to form an image, and wherein said plenum directs a flow of gas around said ink catcher to discourage environmental dust and fibers from approaching and adhering to said ink catcher.

16. The ink jet printing apparatus defined in claim 15, further comprising a recovery reservoir for collecting ink droplets caught by said catcher, wherein said recovery reservoir also collects used liquid cleaning fluid.

17. The ink jet printing apparatus defined in claim 13, wherein said liquid is water, and ink forming said ink droplets is aqueous based.

18. The ink jet printing apparatus defined in claim 13, wherein said cleaning station further includes a source of liquid cleaning fluid, and a valve for selectively connecting said source to said plenum.

19. The ink jet printing apparatus defined in claim 18, wherein said cleaning station further includes a pump for pressurizing said source of liquid cleaning fluid to provide a pressurized stream of liquid cleaning fluid through said plenum.

20. The ink jet printing apparatus defined in claim 12, further comprising a parking mechanism for withdrawing and extending said printhead out of an into an operating position with respect to said apparatus.

21. The ink jet printing apparatus defined in claim 12, wherein said source of pressurized gas is a blower for blowing a pressurized flow of air through said plenum.

22. The ink jet printing apparatus defined in claim 21, wherein said blower is adjustable to blow air flows of greater and lesser pressure through said plenum.

23. An ink jet printing apparatus for printing an image, comprising:

an ink droplet forming mechanism including a printhead having at least one nozzle for ejecting a stream of ink droplets having a selected one of at least two different volumes, said ink droplet forming mechanism being adapted to create in succession ink droplets having a smaller volume of said at least two different ink droplet volumes;

a droplet deflector for producing a flow of gas that interacts with said ink droplet stream to separate ink droplets having said different volumes from one another, and a cleaning station formed at least in part from said droplet deflector for providing a flow of fluid over said printhead to clean and maintain said printhead.

24. The ink jet printing apparatus defined in claim 23, wherein the droplet forming mechanism includes a heater.

25. The ink jet printing apparatus defined in claim 23, wherein said cleaning station provides a flow of liquid cleaning fluid over said printhead.

26. The ink jet printing apparatus defined in claim 23, wherein said fluid flow provided by said cleaning station is a gas flow over said printhead.

27. The ink jet printing apparatus defined in claim 26, wherein said gas flow over said printhead dries liquid cleaning fluid applied to said printhead.

28. The ink jet printing apparatus defined in claim 23, wherein the ink droplets having the smaller volume are created when the ink droplets are ejected from said at least one nozzle.

29. The ink jet printing apparatus defined in claim 23, wherein said droplet deflector includes a plenum for conducting said flow of gas across said printhead to separate said ink droplets, and said cleaning station is formed at least in part from said plenum.

30. The ink jet printing apparatus defined in claim 29, wherein said cleaning station further includes a source of liquid cleaning fluid, and a valve for selectively connecting said source to said plenum.

31. A drop emitter comprising:

an ink droplet forming mechanism including a printhead having at least one nozzle for ejecting a stream of ink droplets having a selected one of at least two different volumes, said ink droplet forming mechanism including a heater;

a droplet deflector for producing a flow of gas that interacts with said ink droplet stream to separate ink droplets having said different volumes from one another, and a cleaning station formed at least in part from said droplet deflector for providing a flow of fluid over said printhead to clean and maintain said printhead.

32. The drop emitter defined in claim 31, wherein said ink droplet forming mechanism is adapted to form at least one of said at least two different ink droplet volumes in succession.

33. The drop emitter defined in claim 32, wherein said at least one of said at least two different ink droplet volumes is a smaller volume when compared to the volume of the other of said at least two different volumes.

34. The drop emitter defined in claim 31, wherein said ink droplet forming mechanism is adapted to eject from said at least one nozzle at least one of said at least two different ink droplet volumes in succession.

35. The drop emitter defined in claim 31, wherein said cleaning station provides a flow of liquid cleaning fluid over said printhead.

36. The drop emitter defined in claim 31, wherein said fluid flow provided by said cleaning station is a gas flow over said printhead.

37. The drop emitter defined in claim 36, wherein said gas flow over said printhead dries liquid cleaning fluid applied to said printhead.

38. The drop emitter defined in claim 31, wherein said droplet deflector includes a plenum for conducting said flow of gas across said printhead to separate said ink droplets, and said cleaning station is formed at least in part from said plenum.

39. The drop emitter defined in claim 38, wherein said cleaning station further includes a source of liquid cleaning fluid, and a valve for selectively connecting said source to said plenum.

* * * * *